United States Patent [19]

Küerten et al.

[11] Patent Number: 4,473,460

[45] Date of Patent: Sep. 25, 1984

[54] CONTINUOUS PREPARATION OF HYDROCARBON OILS FROM COAL BY HYDROGENATION UNDER PRESSURE IN TWO STAGES

[75] Inventors: Heribert Küerten, Neustadt; Hubert Püestel, Dannstadt-Schauernheim; Rudi Schulz, Fussgoenheim; Georg Weber, Ludwigshafen, all of Fed. Rep. of Germany

[73] Assignee: BASF Aktiengesellschaft, Fed. Rep. of Germany

[21] Appl. No.: 344,016

[22] Filed: Jan. 29, 1982

[30] Foreign Application Priority Data

Feb. 12, 1981 [DE] Fed. Rep. of Germany ..... 3105030

[51] Int. Cl.[3] ..... C10G 1/06

[52] U.S. Cl. ..... 208/10

[58] Field of Search ..... 208/10

[56] References Cited

U.S. PATENT DOCUMENTS

| | | | |
|---|---|---|---|
| 3,331,769 | 7/1967 | Gatsis | 208/210 |
| 4,077,867 | 3/1978 | Aldridge et al. | 208/10 |
| 4,152,244 | 5/1979 | Raichle et al. | 208/8 R |
| 4,159,238 | 6/1979 | Schmid | 208/8 LE |
| 4,176,051 | 11/1979 | Ternan et al. | 208/10 X |
| 4,196,072 | 4/1980 | Aldridge et al. | 208/10 |
| 4,300,996 | 11/1981 | Kuehler | 208/8 LE X |
| 4,325,801 | 4/1982 | Kuehler | 208/10 |

FOREIGN PATENT DOCUMENTS

| | | | |
|---|---|---|---|
| 2810479 | 9/1978 | Fed. Rep. of Germany | 208/10 |

*Primary Examiner*—Delbert E. Gantz
*Assistant Examiner*—William G. Wright
*Attorney, Agent, or Firm*—Keil & Weinkauf

[57] ABSTRACT

A process for the continuous preparation of hydrocarbon oils from coal by cracking hydrogenation under pressure in two stages. In the first stage (carried out in the bottom phase) milled coal, together with finely divided catalysts, is pasted with an oil mixture, and the slurry is hydrogenated by heating to 380°–440° C. under a hydrogen pressure of from 200 to 700 bar. The gaseous and liquid reaction products are separated from the solid products and subjected to a further hydrogenation (this time in the gas phase), using a fixed hydrogenation catalyst. The heat of the hydrogenated product is indirectly and separately transferred to the coal/oil mixture and the hydrogen by heat exchange in not less than three stages.

2 Claims, 2 Drawing Figures

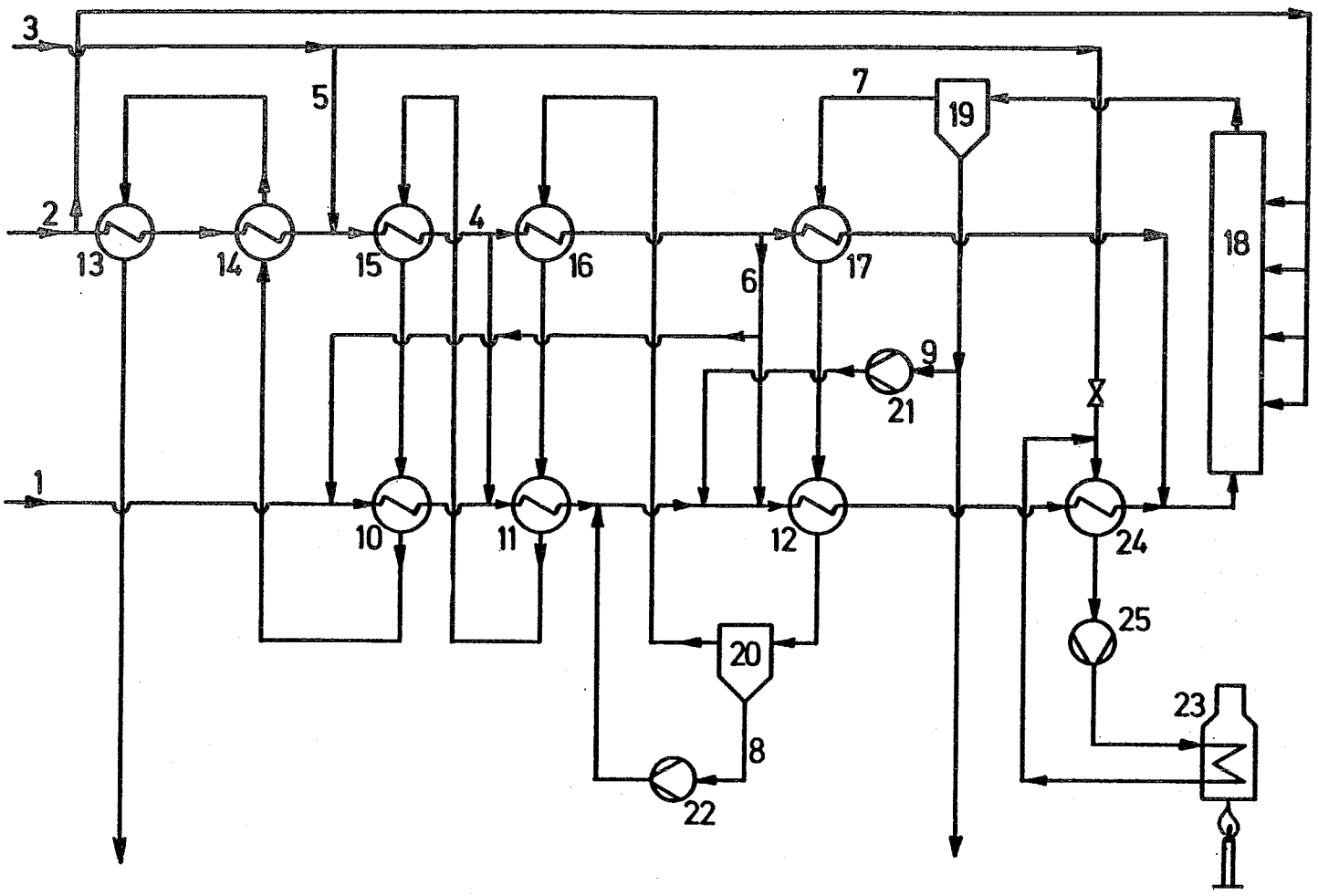
1
2
3
4
5
6
7
8
9
10
11
12
13
14
15
16
17
18
19
20
21
22
23
24
25

CONTINUOUS PREPARATION OF HYDROCARBON OILS FROM COAL BY HYDROGENATION UNDER PRESSURE IN TWO STAGES

It is known that coal may be converted to liquid and gaseous products by hydrogenation under pressure in a slurry phase in the presence of finely divided catalysts, and that the said products can be hydrogenated further, in a gas phase or mixed phase, over a fixed catalyst. In this process, the hydrogenation mixture from the first stage (carried out in the slurry phase) is separated, in a hot separator downstream of the reaction chamber, into gaseous and vaporous products, which are hydrogenated further, and a liquid heavy oil, which contains asphalts, solids, unconverted coal, the coal ash and the added catalyst. The heavy oil is recycled to the hydrogenation process by being used as pasting oil for the coal.

The gaseous products and a proportion of the liquid products are hydrogenated further in one or more reactors, over fixed hydrogenation catalysts, in order to increase the proportion of volatile products.

It is known that the mixture of milled coal, catalyst, pasting oil and hydrogen can be heated conjointly in heat exchangers, using the hot vapors leaving the reactor. These conventional processes do not permit heating the hydrogenation starting materials to 380°–440° C. unless external heat is supplied. Moreover, the conventional processes do not permit cooling the vapors leaving the reactor to the temperature required for further treatment in an oil wash in which the gases formed during the slurry phase hydrogenation are discharged at from 30° to 50° C. Rather, the heat still present in the gases and vapors below 300° C. must be discharged to the environment by use of cooling water.

Heating the starting materials by the conventional processes also creates difficulties, since the high proportion of gas prevents setting up a homogeneous flow. The gas is not dispersed in small bubbles in the coal paste, and instead collects in large bubbles which cause jerky flow of the paste and a high pressure drop in the installation. Under these conditions, the heat transfer efficiency is poor. Moreover, deposits form on the surfaces which are not being flushed with liquid, and as a result heat transfer becomes even worse with time.

It is an object of the present invention to provide a process in which external heat is not needed in continous operation, the heat dissipated to the environment is minimized, and a high pressure drop, and the formation of deposits in the heat exchangers, are avoided.

We have found that this object is achieved by a process for the continuous preparation of hydrocarbon oils from coal by cracking hydrogenation under pressure in two stages, namely a first stage of pasting milled coal, together with finely divided catalysts, with an oil mixture, heating the slurry to 380°–440° C. under a hydrogen pressure of from 200 to 700 bar, passing the mixture through one or more reaction chambers in which it is hydrogenated and separating the gaseous and liquid reaction products from the solid products in hot separators, and a second stage of passing the gaseous and liquid products through one or more reaction chambers, provided with fixed hydrogenation catalysts, and there subjecting them, in the gas phase, to a further hydrogenation, the heat of the end products being transferred to the starting materials by heat exchange, wherein the heat is indirectly and separately transferred to the coal/oil mixture and the hydrogen in not less than three stages by heat exchangers, the heating of the coal/oil mixture in the range from 290° to 340° C. being effected by adding a part of the hot liquid/solid hydrogenation residue and the whole of the condensate, obtained at 390°–410° C., of the gaseous/vaporous hydrogenation products.

The drawing sets forth a flow diagram of a preferred embodiment of the invention.

In a preferred embodiment of the process according to the invention, the coal slurry passing through line (1) together with from 0 to 25% by volume of the recycle gas is heated in tube bundle heat exchangers (10, 11, 12), while the recycle gas passing through line (2) is heated separately in 5 stages in tube bundle heat exchangers (13, 14, 15, 16, 17). Further part-streams are taken from (2).

In the zone where the starting mixture in line (1) is swelling at from 290° to 340° C., indirect heat exchange using tube bundle exchangers is not used, since the narrow tubes of such an apparatus easily become blocked. Instead, swelling takes place under direct heat exchange by admixture of condensate, at 405° C., from the intermediate separator (20) via line (8) and of a part of the residue, at 470° C., from the hot separator (19), via line (9).

Heating of the recycle gas in line (2) and the fresh gas from line (3) is also effected in indirect heat exchangers (13, 14, 15, 16, 17). Downstream of the exchanger (24), recycle gas at 460° C. is admixed to the coal slurry which, on leaving exchanger (12), is at 390° C. This gives a temperature of the mixture of 410° C., which is an adequate entry temperature for the hydrogenation reactor (18). It is moreover possible to take additional part-streams of the recycle gas from lines (2) and (4) and admix these to the coal slurry. The entire heat required for heating up the slurry is taken from the stream of hydrogenation products (7). The fired heater (23), which employs fresh hydrogen, from line (3), as the thermal medium, and the tube bundle heat exchanger (24), are merely used for start-up of the installation. The centrifugal pump (22) is used to convey the condensate from the intermediate separator, and the piston pump (21) is used to convey a part-stream of the residue through line (9).

According to the invention, only up to 25% by volume of the recycle gas is admixed via line (6) to the coal slurry, while another part of the gas from line (2) is used to cool the reactor (18). The remainder of the recycle gas from line (4) is heated separately in 5 stages. Problems such as result from excessively high wall temperatures when using fluegas-heated preheaters are avoided by the arrangement described here, since such preheaters are not required. Heat exchange in counter-current is achievable with coal slurry and gases by dividing the process over a sufficiently large number of regenerators. The small proportion of gas has the effect that a stable fine-bubbled dispersion is produced, with an advantageous effect on the viscosity and pressure drop of the coal slurry. The difficulties which arise in dividing multi-phase systems, in which extensive phase separation has occured, over parallel lines (as in a tube bundle) are avoided in the case of a mult-phase system containing fine bubbles. The swelling range of from 290° to 340° C. can also be controlled by admixture of hot recycled product and intermediate-separator condensate. It is advantageous if the coal slurry is heated regeneratively until swelling commences at 290° C., and the swelling range is avoided by direct heat exchange with hot recycled product, since the equipment problems which the swelling of the coal presents are less if direct heat exchange is employed.

Difficulties attributable to separation of the gaseous phase from the liquid/solid phase are reduced. Advantageously, the suspension is prepared at a concentration of 40% solids. In general, the process according to the invention permits conveying suspensions containing from 38 to 58 wt. % solids.

A particular technical advantage achieved in the process according to the invention is that the difficulties resulting from the fact that the coal particles swell at from 290° to 340° C. can be managed. Swelling in this temperature range, occurring in the coal/oil mixture, causes an increase in viscosity by a factor of almost 100. Flow blocking in the swelling range can, according to the invention, be avoided, if the concentration in the pasting oil is brought to <40 weight % solids and the stepwise heating described above is employed.

We claim:

1. In a process for the continuous preparation of hydrocarbon oils from coal by cracking hydrogenation under pressure in two stages, namely a first stage of pasting milled coal, together with finely divided catalysts, with an oil mixture to form a coal/oil slurry mixture, heating the slurry to 380° -440° C. under a hydrogen pressure of from 200 to 700 bar, passing the mixture through one or more reaction chambers in which it is hydrogenated (this constituting a slurry-phase hydrogenation) and separating the gaseous and liquid reaction products from the solid products in hot separators, and a second stage of passing the gaseous and liquid products through one or more reaction chambers, provided with fixed hydrogenation catalysts, and there subjecting them, in the gas phase, to a further hydrogenation, the heat of the end products being transferred to the starting materials by heat exchange, the improvement which comprises: transferring the heat of the end products indirectly and separately to the coal/oil mixture and the hydrogen in not less then three stages, and directly heating the coal/oil mixture having a temperature in the range from 290 to 340° C. by adding to this portion of the coal/oil mixture a part of the hot liquid/solid hydrogenation residue and the whole of the condensates, obtained at 390°-410° C., of the gaseous/vaporous hydrogenation products.

2. A process as set forth in claim 1, wherein a coal/oil/catalyst slurry having a solids content of from 38 to 58% by weight is used as the starting mixture.

* * * * *